United States Patent [19]

Furushima

[11] Patent Number: 5,070,324

[45] Date of Patent: Dec. 3, 1991

[54] VARIABLE MAGNIFICATION COPIER

[75] Inventor: Tadashi Furushima, Yokohama, Japan

[73] Assignee: Ricoh Company, Ltd., Tokyo, Japan

[21] Appl. No.: 404,205

[22] Filed: Sep. 7, 1989

[30] Foreign Application Priority Data

Sep. 7, 1988 [JP] Japan ..... 63-223763

[51] Int. Cl.[5] ..... G09G 3/02

[52] U.S. Cl. ..... 340/706; 340/712; 355/55; 355/243

[58] Field of Search ..... 340/706, 735, 712; 355/55, 243; 341/23

[56] References Cited

U.S. PATENT DOCUMENTS

| | | | |
|---|---|---|---|
| 4,477,797 | 10/1984 | Nakagiri | 340/712 |
| 4,614,423 | 9/1986 | Yoshiura | 355/243 |
| 4,647,189 | 3/1987 | Fugiwara et al. | 355/55 |
| 4,814,824 | 3/1989 | Ito et al. | 355/55 |
| 4,891,670 | 1/1990 | Kanbayashi | 355/243 |

*Primary Examiner*—Ulysses Weldon
*Assistant Examiner*—M. Fatahiyar
*Attorney, Agent, or Firm*—Oblon, Spivak, McClelland, Maier & Neustadt

[57] ABSTRACT

A variable magnification copier capable of copying an original document in a zoom magnification change mode when the size of the document and a desired copy size are entered on keys. The copier has an operation board which is provided with a dimensional magnification change mode key, a document size key, a copy size key, and a magnification change ratio and size data display. In a dimensional magnification change mode, the data display shows a document size and a desired copy size which are entered on the document size and copy size keys, respectively. Such size data are automatically provided with a decimal point, whereby the operation board does not need an exclusive decimal point key. Data appearing on the data display is switched over to size data without a decimal point, depending on the unit of the entered size.

5 Claims, 10 Drawing Sheets

| Fig.4A |
| --- |
| Fig.4B |

VARIABLE MAGNIFICATION COPIER

BACKGROUND OF THE INVENTION

The present invention relates to a variable magnification copier capable of copying an original document in a zoom magnification change mode when the size of the document and a desired copy size are entered on keys.

In the office automation equipment art, there is an increasing demand for easy and simple manipulations. This is also true with a copier of the type having a zoom magnification change capability which involves dimensional magnification change. Dimensional magnification change has customarily been implemented by an operation board having a dimensional magnification change key, numeral keys, and an exclusive decimal key. Specifically, when the dimensional magnification change key is depressed, a document size display shows "0 inch", for example. Thereafter, when the numeral keys and decimal point key are manipulated to enter a numerical value such as "11.0", the document size display displays "11.0 inch" thereon. When an enter key is pressed, a copy size in inches appears on a copy size display as "0 inch". Then, the numeral keys and decimal point key are manipulated again to enter a numerical value such as "8.5", resulting in "8.5 inch" appearing on the copy size display. Finally, the enter key is pressed again, resulting in the appearance of a calculated magnification change ratio of "77% ".

As stated above, the prior art dimensional magnification change input procedure necessarily requires one to manipulate the decimal point key in the event of entry of size data. Stated another way, the decimal point key is used in the dimensional magnification change mode only. Moreover, the use of the dimensional magnification change mode itself is rare, i.e., a regular size magnification change mode such as A4 to B5 magnification is predominant in the variable magnification change. Nevertheless, all the prior art copiers of the type having a dimensional magnification changing function are provided with a decimal point key. This is contradictory to the demand for easy and simple operations of office automation equipment.

SUMMARY OF THE INVENTION

It is therefore an object of the present invention to provide a variable magnification copier which is easy to operate.

It is another object of the present invention to provide a variable magnification copier which simplifies inputting operations in a dimensional magnification change mode.

It is another object of the present invention to provide a variable magnification copier which eliminates the need for a decimal point key heretofore arranged on an operation board.

It is another object of the present invention to provide a generally improved variable magnification copier.

A copier having a magnification changing function of the present invention comprises an operation board having at least a dimensional magnification change mode key, a document size input key, a copy size input key, and a magnification change ratio and size data display, and a control unit for automatically switching data appearing on the magnification change ratio and size data display to size data with a decimal point when a size is to be displayed in a dimensional magnification change mode selected by the dimensional magnification change mode key.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

A variable magnification copier embodying the present invention will be described hereinafter. The illustrative embodiment relates to a copier having a zooming function. This type of copier may be implemented with a conventional magnification changing mechanism, and details of such a mechanism will not be described.

Figure 1:
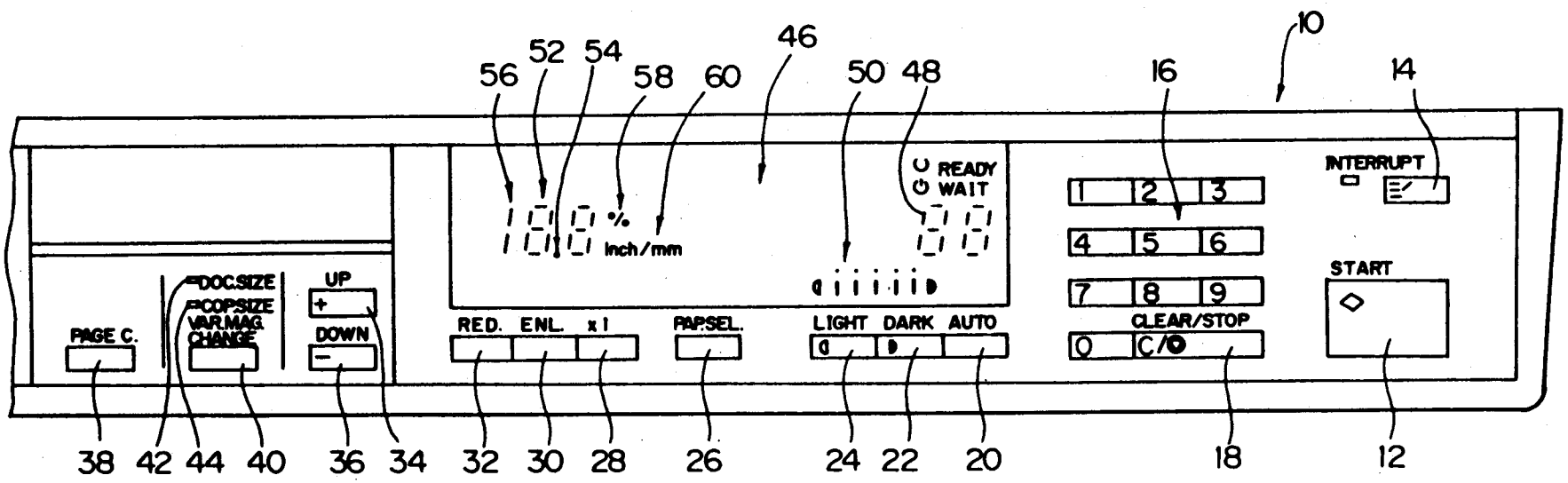
FIG. 1 is a plan view of an operation board included in a variable magnification copier embodying the present invention.

Referring to FIG. 1 of the drawings, an operation board included in the illustrative embodiment is shown and generally designated by the reference numeral 10. The operation board 10 has a start key 12, an interrupt key 14, numeral keys 16, and a clear/stop key 18 at the right-hand side thereof, as has been customary with prior art copiers. The numeral keys 16 are accessible for entering a document size and a desired copy size, as will be described in detail later. It is noteworthy that the key arrangement of the illustrative embodiment does not include a decimal point key heretofore located in the vicinity of the numeral keys 16. Also arranged on the operation board 10 are various mode keys such as an automatic density key 20, a density-up key 22, a density-down key 24, a paper (cassette) select key 26, a ×1 key, an enlarge key 30 assigned to legal sizes, a reduce key 32 also assigned to legal sizes, a zoom-up key 34, a zoom-down key 36, and a page continue key 38. A dimensional magnification change mode key 40 is adapted to set up a dimensional magnification change mode which is an essential mode in this embodiment. Light emitting diodes (LEDs) 42 and 44 are the indicators associated with the key 40 for displaying operation and processing conditions in this particular mode. Specifically, the LEDs 42 and 44 serve as a document size input indicator and a copy size input indicator, respectively.

A display section 46 is located above the keys 20 to 32 as viewed in FIG. 1 so as to display various kinds of information thereon. The display section 46 has a 7-segment numerical display 48 for displaying the number of copies produced and other similar numerical information, a density display 50 for displaying a density stepwise, and a magnification change ratio and size data display 52 located in close proximity to the magnification change and dimensional magnification change keys 28, 30 and 32 for implementing indications which are unique to the illustrative embodiment. Specifically, the size data display 52 is made up of a 7-segment display portion 56 with a decimal point 54 for displaying a numerical value, a % display portion 58 which is selectively turned on, and an inch/mm display portion 60. The inch/mm display portion 60 displays either one of "inch" and "mm" as commanded by an exclusive external switch 62, FIG. 2. With the display portion 60 and key 62, the copier allows one to enter sizes in either one of inches or millimeters as desired. Usually, a size in inches is entered on a 0.1 inch basis, while a size in millimeters is entered on a 1 millimeter basis and, therefore, will not need the display of the decimal point.

Figure 2:
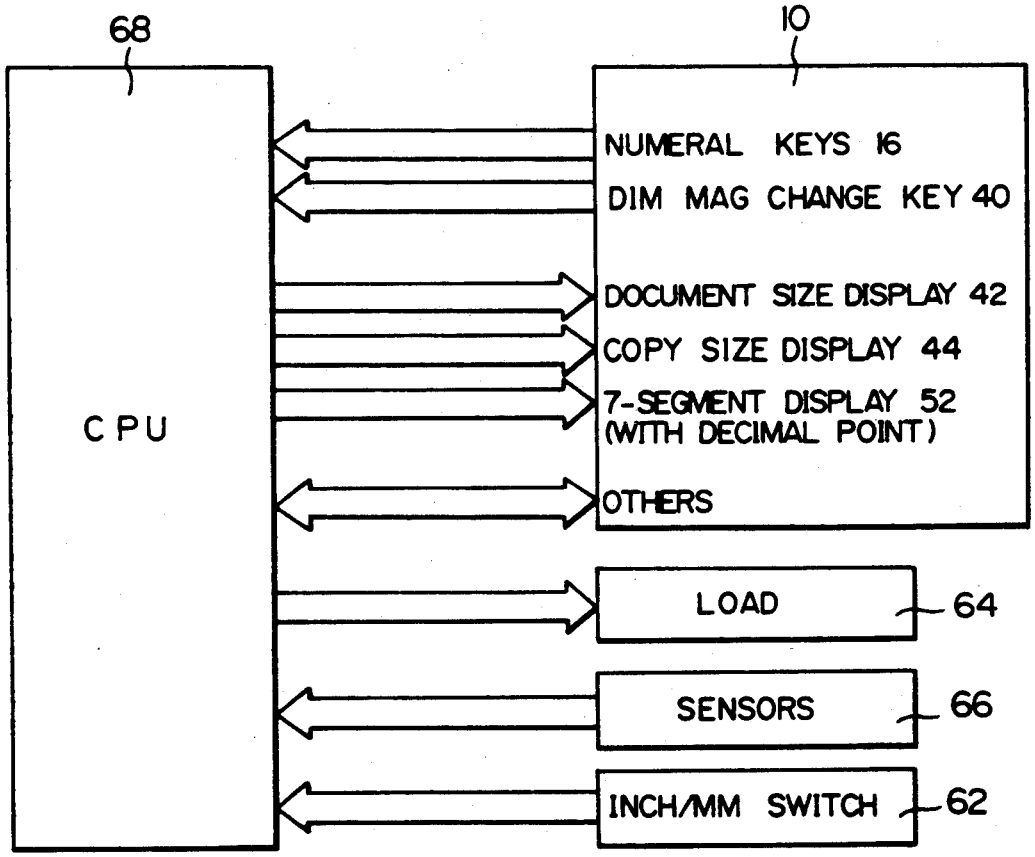
FIG. 2 is a block diagram schematically showing a control arrangement installed in the copier of FIG. 1.

As shown in FIG. 2, the operation board 10 having various keys, indicators and displays as stated above is controlled by a CPU (Central Processing Unit) 68 which is implemented as a microcomputer. Also controlled by the CPU 68 are various sensors 66 which are installed in the copier.

A reference will be made to FIGS. 3 to 6 for describing how to operate the operation board 10, processing, control, etc.

Figure 3:
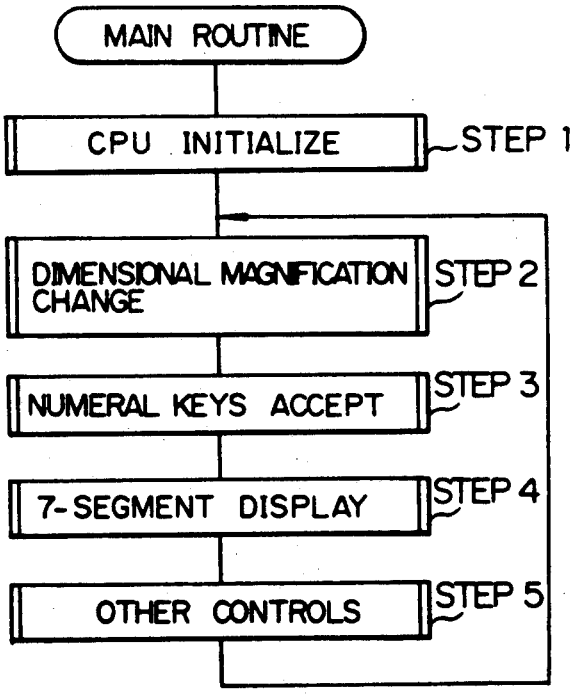
FIG. 3 is a flowchart demonstrating a main routine of the illustrative embodiment.

FIG. 3 shows a main routine which begins with a STEP 1 for initializing the CPU 68. Specifically, when a power switch of the copier is turned on, the CPU 68 is initialized to clear a RAM and other similar components built therein, to set up copying conditions, etc. Thereafter, the CPU 68 executes a key 40 input accept routine 40 (STEP 2), a keys 16 input accept routine (STEP 3), a 7-segment display routine (STEP 4), and other control routines (SEP 5).

Figures 4, 4A:
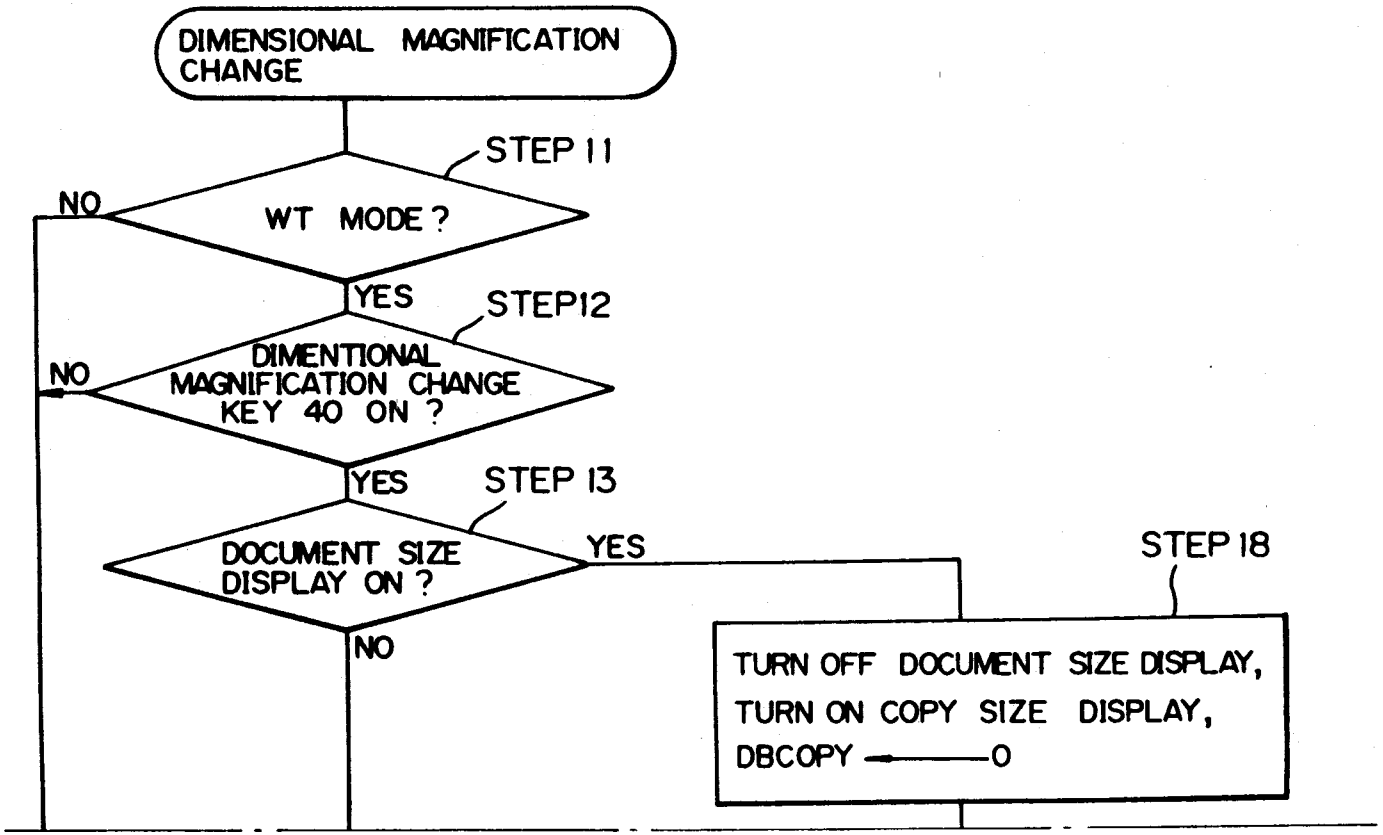
FIGS. 4A-B, 5A-B and 6 are flowcharts each showing a subroutine included in the main routine.
Figure 4B:
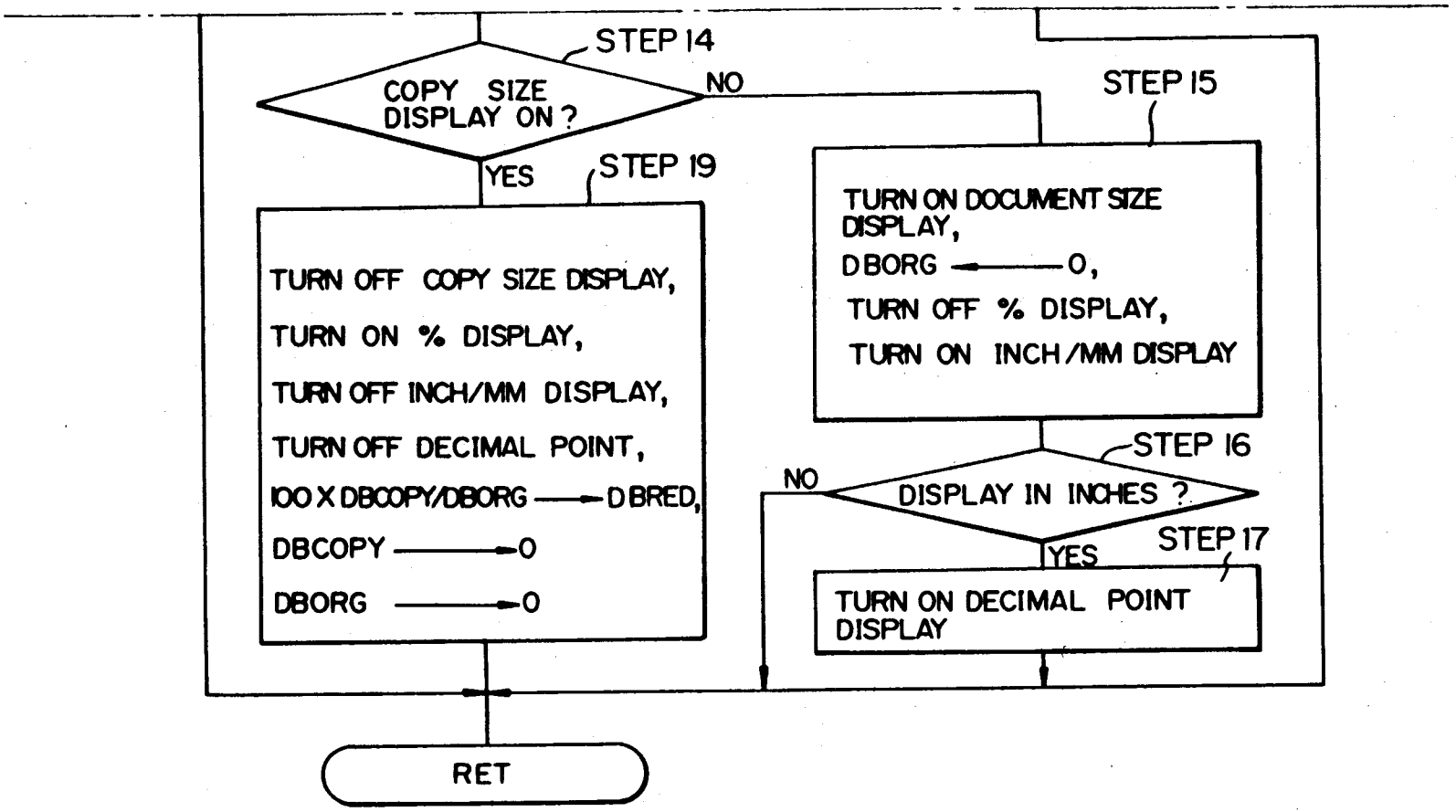

Referring to FIG. 4, the key 40 input accept routine is shown specifically. First, the CPU 68 determines whether or not a WT mode has been set up, i.e., whether or not to accept an input on the dimensional magnification change mode key 40 (STEP 11). If the answer of the STEP 11 is NO, the operation is transferred to the keys 16 input accept routine which will be described. If the answer of the STEP 11 is YES, the CPU 68 checks the key 40 to see if it has been pressed (STEP 12). After the key 40 has been pressed to select the dimensional magnification change mode, the CPU 68 determines whether or not the LEDs 42 and 44 associated with the size of a document and that of a copy, respectively, are ON (STEPS 13 and 14). In the beginning, both the LEDs 42 and 44 are OFF. Hence, as shown in a STEP 15, the LED 42 assigned to a document size is turned on, a document size data buffer DBORG is reset to "0 (zero)", the % display portion 58 is turned off, and the inch/mm display portion 60 is turned on. Then, the CPU 68 checks the inch/mm display portion to see if "inch" has been selected (STEP 16). If "inch" has been selected through the external switch 62, the CPU 68 turns on the decimal point display portion 54 also (STEP 17). Consequently, the data display 52 is automatically switched over from an ordinary magnification change ratio such as "100%" to size data with a decimal point such as "0.01 inch". This urges the operator to enter the size of a document.

Figure 5A:
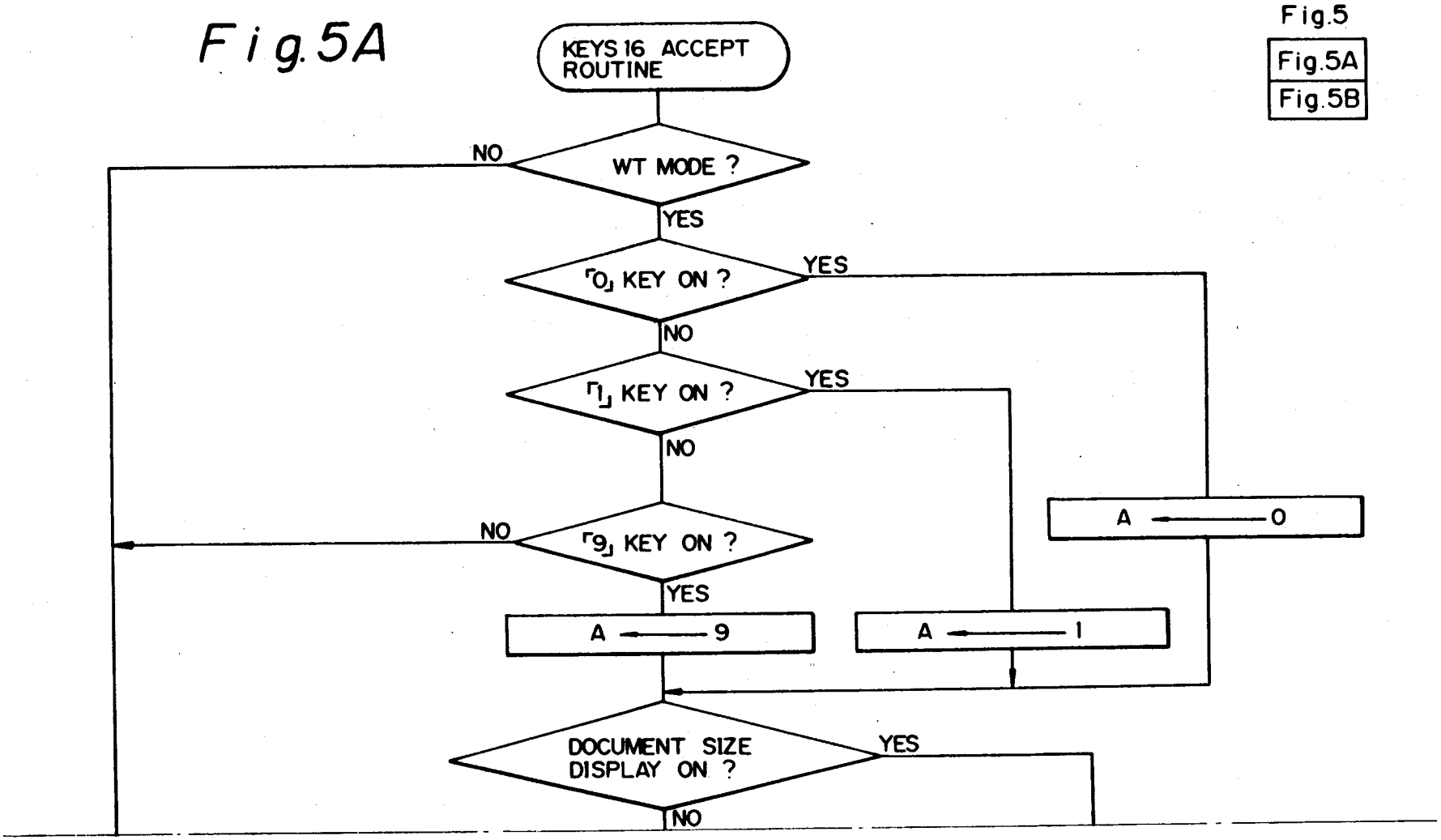
Figure 5B:
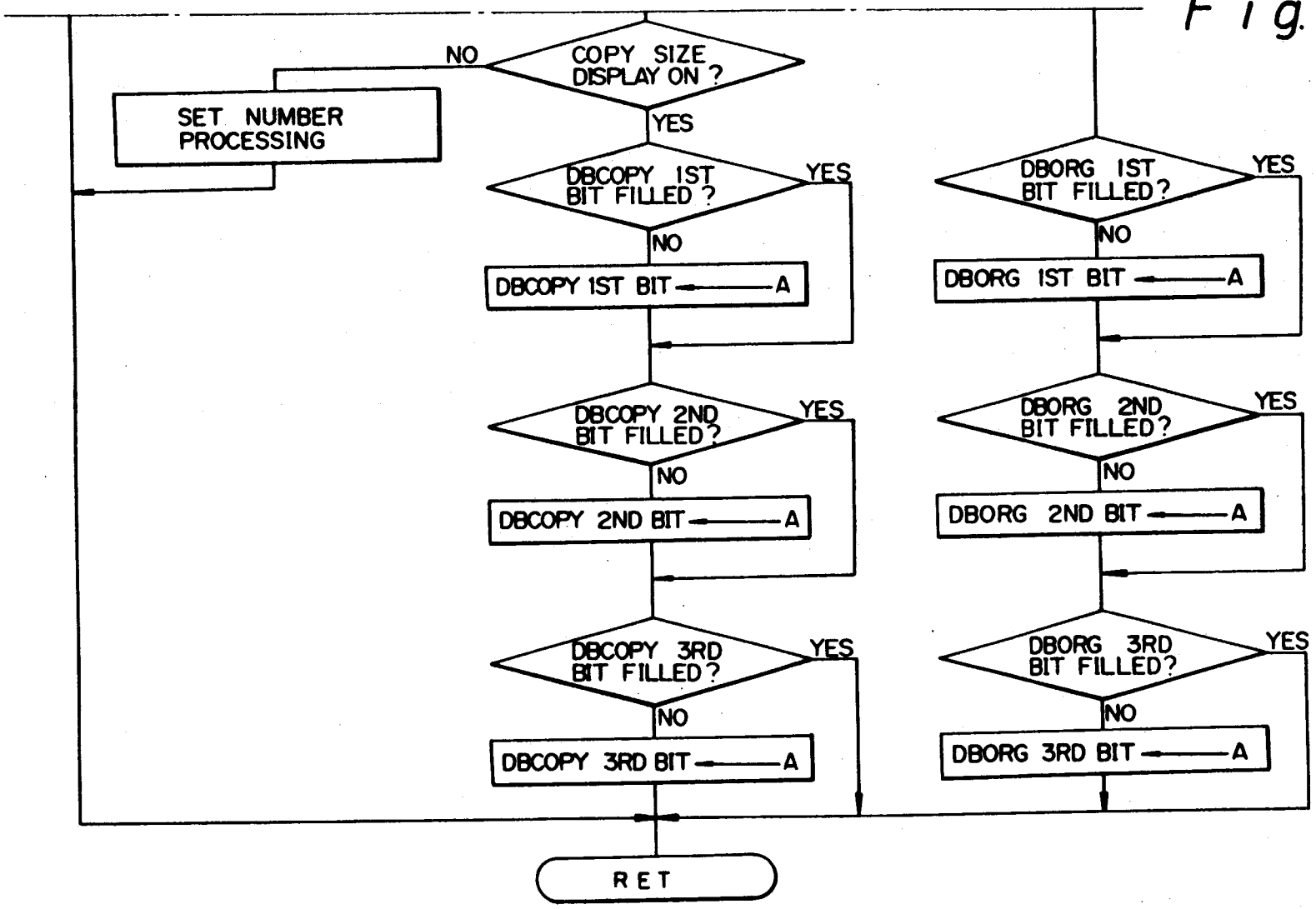
Figure 6:
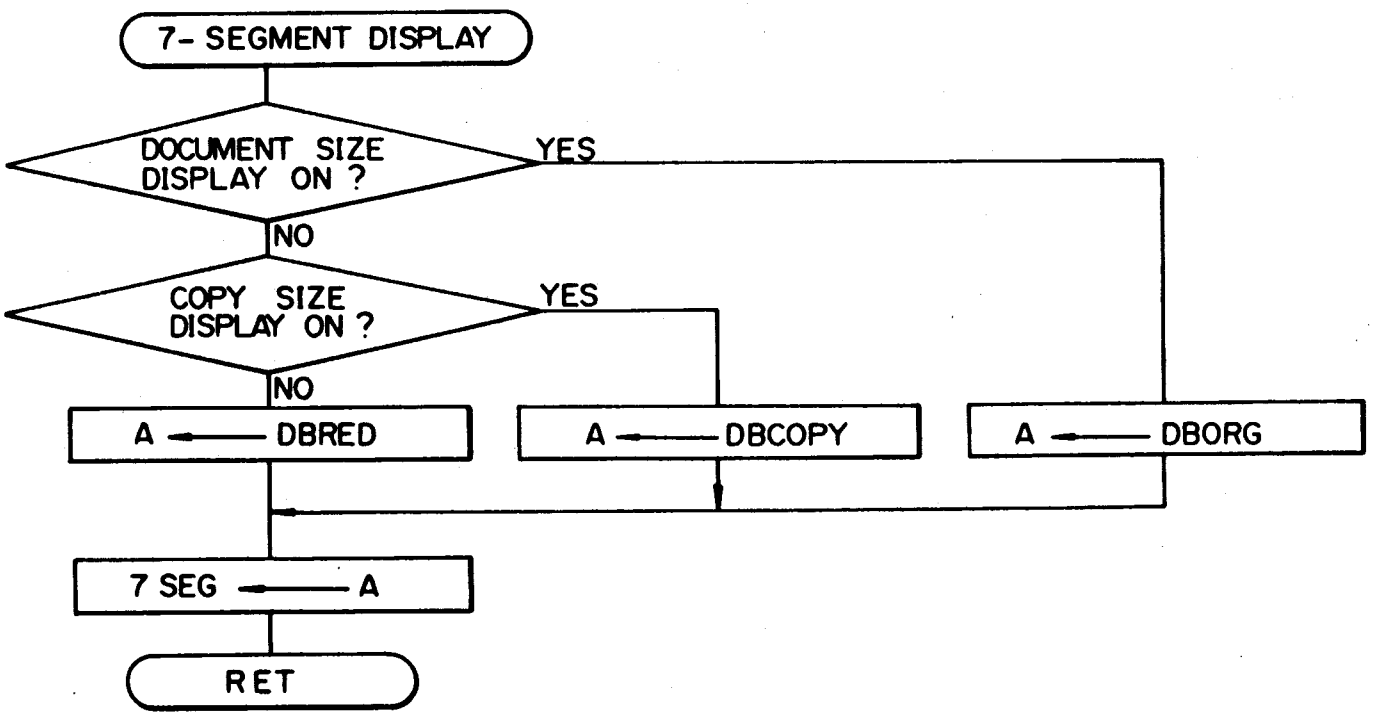

As the operator enters the size of a desired document on the numeral keys 16, the keys 16 input accept routine is executed, as shown in FIG. 5. Specifically, a numerical value associated with the manipulated keys 16 is sequentially stored in any of the first, second and third bits of the document size data buffer DBORG. This is followed by the 7-segment display routine which is shown in FIG. 6 specifically. In FIG. 6, the numerical value stored in the bits of the data buffer DBORG is displayed. For example, when the operator enters "1", "1" and "0" on the numeral keys 16 sequentially, the data display 52 will show the size data with a decimal point as "11.0 inch". The document size so entered may be cancelled by operating the clear/stop key 18. Confirming that the entered numerical value is correct, the operator presses the dimensional magnification change mode key 40 to fix the entered document size. At this time, as shown in FIG. 4, the LED 42 assigned to the document size is ON (STEP 13). Hence, the CPU 68 turns off the LED 42, and then turns on the LED 44 assigned to the copy size to urge the operator to enter a desired copy size while resetting a copy size data buffer DBCOPY to "0" (STEP 18). The resulting data appearing on the data display 52 is "0.0 inch".

As the operator enters a desired copy size on the numeral keys 16, a numerical value associated with the operated numeral keys 16 is sequentially stored in any of the first, second and third bits of the copy size data buffer DBCOPY according to the keys 16 input accept routine shown in FIG. 5. This is followed by the 7-segment display routine shown in FIG. 6, i.e., the numerals stored in the bits of the data buffer DBCOPY are displayed. Assuming that the operator has entered "8" and "5" on the ten keys 16 in this order, then the data display 52 shows the size data with a decimal point "8.5 inch". Again, such a copy size may cancelled by operating the clear/stop key 18, if necessary. If the entered copy size is correct, the operator presses the dimensional magnification mode key 40 to fix the entered copy size. At this time, the LED 42 is OFF (STEP 13, FIG. 4) and the LED 44 is ON (STEP 14, FIG. 4). Hence, the CPU 68 turns off the LED 44 also, and then turns on the % display portion 58 while turning off the inch/mm display portion 60 and decimal point display portion 54. Thereupon, the CPU 68 determines a magnification change ratio in size magnification change by using a formula 100×(DBCOPY/DBORG), stores it in a magnification change ratio data buffer DBRED, and clears the other buffers DBCOPY AND DBORG. Then, the 7-segment display routine shown in FIG. 6 is executed to show the content of the data buffer DBRED on the data display 52. Specifically, ordinary numerical data without a decimal point is displayed in terms of %, i.e. "77%". This completes the settings for the dimensional magnification change mode operation. As the operator presses the start key 12, the copier performs copying operations on the basis of the determined magnification change ratio.

Figure 7A:
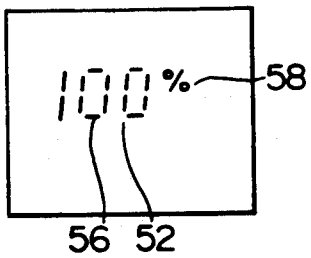
FIGS. 7A to 7F show a sequence of display conditions associated with the operations of keys particular to the illustrative embodiment.
Figure 7B:
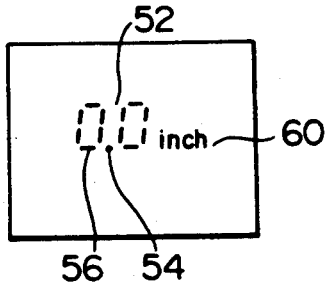
Figure 7C:
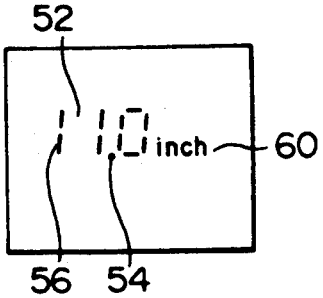
Figure 7D:
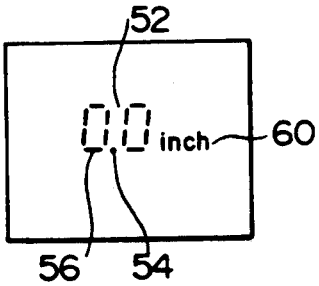
Figure 7E:
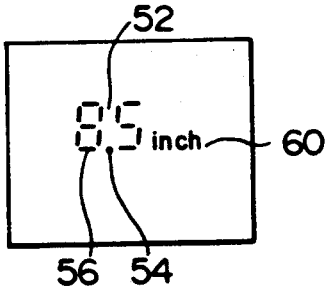
Figure 7F:
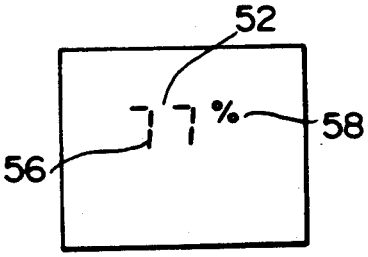

FIGS. 7A to 7F indicate specific data which may be displayed in the dimensional magnification change mode. In an odinary mode, turning on the power switch of the copier causes a magnification change ratio to appear on the data display 52 in terms of % such as "100%", as shown in FIG. 7A. When the dimensional magnification change mode key 40 is pressed, the data appearing on the data display 52 is changed from "100%" over to size data with a decimal point "0.0 inch", as shown in FIG. 7B. Thereafter, as the numeral keys 16 are operated to enter numerals representative of a particular document size sequentially, e.g., "1", "1" and "0" in this sequence, size data with a decimal point "11.0 inch" appears on the data display 52, as shown in FIG. 7C. When the key 40 is pressed to fix the entered document size, the LED 44 assigned to a copy size is turned on while size data with a decimal point "0.01 inch" is displayed on the data display 52, as shown in FIG. 7D. This urges the operator to enter a desired copy size on the numeral keys 16. When the operator enters "8" and "5" in this sequence, for example, the data display 52 displays copy size data with a decimal point "8.5 inch", as shown in FIG. 7E. When the operator presses the key 40 again to fix the entered copy size, the CPU 68 turns off both the LEDs 42 and 44, switches the data display 52 to the magnification change ratio display. As a result, a magnification change ratio without a decimal point, i.e., "77%" appears on the data display 52, as shown in FIG. 7F.

As stated above, the illustrative embodiment realizes a simplified operation board which does not need a decimal point key, thereby promoting simple manual operations in a dimensional magnification change mode. Specifically, despite the use of a single data display 52, ordinary numerical data without a decimal point is displayed in terms of % in an ordinary mode and when a magnification change ratio is to be indicated in a dimensional magnification change mode, while numerical data in inches is provided with a decimal point automatically, i.e., without resorting to an extra manipulation when size data is to be displayed in the dimensional magnification change mode.

Figure 8A:
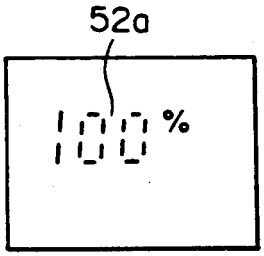
Fig. 8A PRIOR ART
FIGS. 8A to 8F are views similar to FIGS. 7A to 7F, showing prior art display conditions.
Figure 8B:
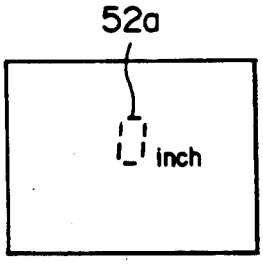
Fig. 8B PRIOR ART
Figure 8C:
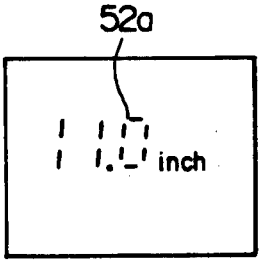
Fig. 8C PRIOR ART
Figure 8D:
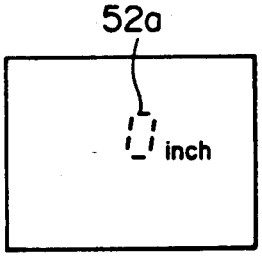
Fig. 8D PRIOR ART
Figure 8E:
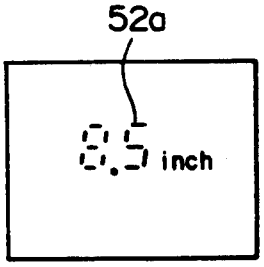
Fig. 8E PRIOR ART
Figure 8F:
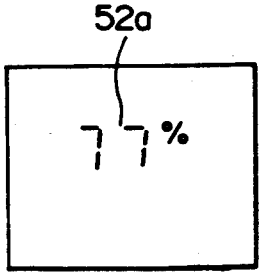
Fig. 8F PRIOR ART

FIGS. 8A to 8F show a prior art data inputting procedure and display conditions and are individually associated with FIGS. 7A to 7F. When a power switch is turned on and in an ordinary mode or similar mode, a data display 52a shows a magnification change ratio with %, e.g., "100%", as shown in FIG. 8A. As the operator presses a dimensional magnification change mode key, an LED assigned to a document size is turned on while the data display 52a is switched over to dimensional data "0 inch", as shown in FIG. 8B. Then, the operator manipulates numeral keys and a decimal point key sequentially to enter a document size, e.g., "1", "1", "." and "0". This causes the data display 52a to show size data with a decimal point "11.0 inch", as shown in FIG. 8C. As the operator presses the dimensional magnification change mode key to fix the entered document size, an LED assigned to a copy size is turned on while the data display 52a is switched over to size data "0 inch", as shown in FIG. 8D. This urges the operator to enter a desired copy size. When the operator enters "8", "." and "5" sequentially on the numerical keys and decimal point key, the data display 52a displays copy size data with a decimal point "8.5 inch", as shown in FIG. 8E. Thereupon, as the operator operates the dimensional magnification change mode key to fix the entered copy size, both of the LEDs are turned off and the data display is switched to a calculated magnification change ratio "77%", as shown in FIG. 8. In this manner, although the prior art is capable of displaying the same data as the illustrative embodiment, it requires one to operate the decimal point key every time a size should be inputted.

In summary, in accordance with the present invention, a copier has an operation board which is provided with a dimensional magnification change mode key, a document size key, a copy size key, and a magnification change ratio and size data display, and control means for automatically switching over the data display to size data with a decimal point when a size is to be displayed in the dimensional magnification change mode selected by the dimensional magnification change mode key. This eliminates the need for a special decimal point key and thereby simplifies the construction of the operation board. Since the indication of magnification change ratio data and that of size input data are implemented by a single display and since the decimal point is provided automatically as needed, one is freed from troublesome manipulations in the dimensional magnification change mode.

Various modifications will become possible for those skilled in the art after receiving the teachings of the present disclosure without departing from the scope thereof.

I claim:

1. A copier having a magnification changing function, comprising:

an operation board having at least a dimensional magnification change mode key, a document size input key, a copy size input key, and a magnification change ratio and size data display;

control means for automatically switching data appearing on said magnification change ratio and size data display to size data when a size is to be displayed in a dimensional magnification change mode selected by said dimensional magnification change mode key; and selecting means for selecting one of a plurality of units;

wherein said control means controls said selecting means to automatically display size data, without a decimal point, when a unit selected by said selecting means has only integer values of size data.

2. A copier as claimed in claim 1, wherein the size is selectively displayed in a plurality of units.

3. A copier as claimed in claim 2, wherein the plurality of units comprise at least inch and millimeter.

4. A copier as claimed in claim 3, wherein the unit without a decimal point comprises millimeter.

5. A copier having a magnification change function, comprising:

an operation board having at least a dimensional magnification change mode key, a document size input key, a copy size input key, and a data display for alternately displaying a magnification change ratio and size data;

an exclusive switch determing means which determines a selected unit for size data display, display control means for automatically displaying one of magnification change ratio data and size data on said data display, including initializing means for initializing display control means values when said copier is turned on, a dimensional magnification change inputting means for inputting a dimensional magnification, and numeral keys accept means for accepting data from numeral keys;

wherein said dimensional magnification change inputting means includes wait mode determining means to determine when to accept a dimensional magnification change input, dimensional magnification change key determining means to determine to accept a dimensional magnification change key input, document size data acceptance determining means to determine when document size data is to be accepted, document size data display indicating means to indicate that document size data is to be input, document size data accepting means for accepting document size data from said numeral keys when said document size data acceptance determining means determines that document size data is to be accepted, copy size data acceptance determining means to determine when copy size data is to be accepted, copy size data display indicating means to indicate that copy size data is to be input;

copy size data accepting means for accepting copy size data from said numeral keys when said copy size data acceptance determining means determines that copy size data is to be accepted;

wherein said document size data accepting means includes document size data buffer reset means for resetting a document size data buffer to zero, and wherein said display control means automatically removes said magnification change ratio data and displays said size data in said display means, said size data displayed in said selected units when said display control means determines that size data is to be input, wherein said display control means automatically displays a decimal point in said size data display, only when said selected unit is a member of the group of units having fractional data values for said magnification change function.

* * * * *